US008091591B2

(12) United States Patent
Knieling

(10) Patent No.: US 8,091,591 B2
(45) Date of Patent: Jan. 10, 2012

(54) DEVICE FOR FILLING VESSELS

(75) Inventor: Erwin Knieling, Pfatter (DE)

(73) Assignee: Krones AG, Neutraubling (DE)

( * ) Notice: Subject to any disclaimer, the term of this patent is extended or adjusted under 35 U.S.C. 154(b) by 765 days.

(21) Appl. No.: 11/913,916

(22) PCT Filed: May 3, 2006

(86) PCT No.: PCT/EP2006/004103

§ 371 (c)(1),
(2), (4) Date: Oct. 6, 2008

(87) PCT Pub. No.: WO2006/119893

PCT Pub. Date: Nov. 16, 2006

(65) Prior Publication Data

US 2009/0071566 A1 Mar. 19, 2009

(30) Foreign Application Priority Data

May 11, 2005 (DE) ..... 20 2005 007 446 U

(51) Int. Cl.
*B65B 31/00* (2006.01)

(52) U.S. Cl. ..... 141/57; 141/45; 141/48; 141/50; 141/52

(58) Field of Classification Search ..... 141/39–63
See application file for complete search history.

(56) References Cited

U.S. PATENT DOCUMENTS

| | | | | |
|---|---|---|---|---|
| 3,381,723 | A * | 5/1968 | Quest | 141/39 |
| 3,797,535 | A | 3/1974 | Kaiser et al. | |
| 3,946,770 | A | 3/1976 | Trinne et al. | |
| 5,501,253 | A * | 3/1996 | Weiss | 141/40 |
| 6,189,578 | B1 * | 2/2001 | Clusserath | 141/7 |
| 6,463,964 | B2 * | 10/2002 | Clusserath | 141/40 |
| 7,353,848 | B2 * | 4/2008 | Krulitsch | 141/56 |

FOREIGN PATENT DOCUMENTS

| | | |
|---|---|---|
| EP | 0601514 | 6/1994 |
| GB | 625971 | 7/1949 |

* cited by examiner

*Primary Examiner* — Timothy L Maust
(74) *Attorney, Agent, or Firm* — Marshall, Gerstein & Borun LLP

(57) ABSTRACT

A device for the filling of vessels, with a container for liquid and pressurized gas and at least one filling pipe connected with this, which filling pipe comprises a liquid valve and a return gas pipe, whereby a gas pipe discharges into the filling pipe outside the return gas pipe, which gas pipe is connected with the container by means of a pre-stressing valve, so that the pre-stressing valve is positioned on the upper side of the container and the gas pipe discharges into the container from above.

4 Claims, 2 Drawing Sheets

DEVICE FOR FILLING VESSELS

CROSS-REFERENCE TO RELATED APPLICATION

The present application claims the benefit of priority of International Patent Application No. PCT/EP2006/004103 filed on May 3, 2006, which application claims priority of German Patent Application No. 20 2005 007 446.2 filed May 11, 2005. The entire text of the priority application is incorporated herein by reference in its entirety.

FIELD OF THE DISCLOSURE

The disclosure relates to a device for the filling of vessels, such as used in beverage bottling operations.

BACKGROUND OF THE DISCLOSURE

Such a type of device, in which the pre-stressing valve is seated on the lower side of the container directly next to the filling pipe, and the pressurized gas pipe, in the form of a tube, discharges into the gas-filled space immediately above the level of liquid in the container, is already known (GB 625 971).

In this known device, the conveying of pressurized gas into a vessel pressed against the filling pipe while bypassing the return gas pipe is carried out through the separate pressurized gas pipe, so that liquid residues or foam particles from the previous filling process possibly remaining behind in the return gas pipe cannot enter into the vessel. These liquid and foam particles would otherwise favor the release of gas from the liquid subsequently entering into the vessel and lead to an impermissibly great formation of foam. This is particularly critical during the decanting of beverages which have a high carbon dioxide content or which are hot.

In the known device, however, drops of liquid or particles of foam can, because of the above-stated opening in the pressurized gas pipe, easily penetrate into the pressurized gas pipe and accumulate above the pressurized gas valve positioned below. The advantage of a "dry prestressing" that is theoretically present is thereby again nullified.

SUMMARY OF THE DISCLOSURE

The task that forms the basis of the disclosure is that of making possible a dry pressurization of the vessel in a device of the type stated above by simple means, even in the event of unfavorable operating conditions.

In one device in accordance with the disclosure, the area of the pressurized gas pipe between the pre-stressing valve and the point of discharge into the gas-filled space is relatively short and open towards the bottom, so that no portions of liquid can penetrate in practice. The remaining area of the pressurized gas pipe between the pre-stressing valve and the filling pipe is, in any event, secured by the closed pre-stressing valve.

The pressurized gas pipe can also be connected to a source of correction gas or of rinsing gas by means of additional valves positioned above the container, for example, and can thus be generally used as an additional gas channel proceeding in parallel to the return gas pipe.

BRIEF DESCRIPTION OF THE DRAWINGS

One embodiment of the disclosure is described in the following by means of the diagrams. These depict the following.

DETAILED DESCRIPTION

Figure 1:
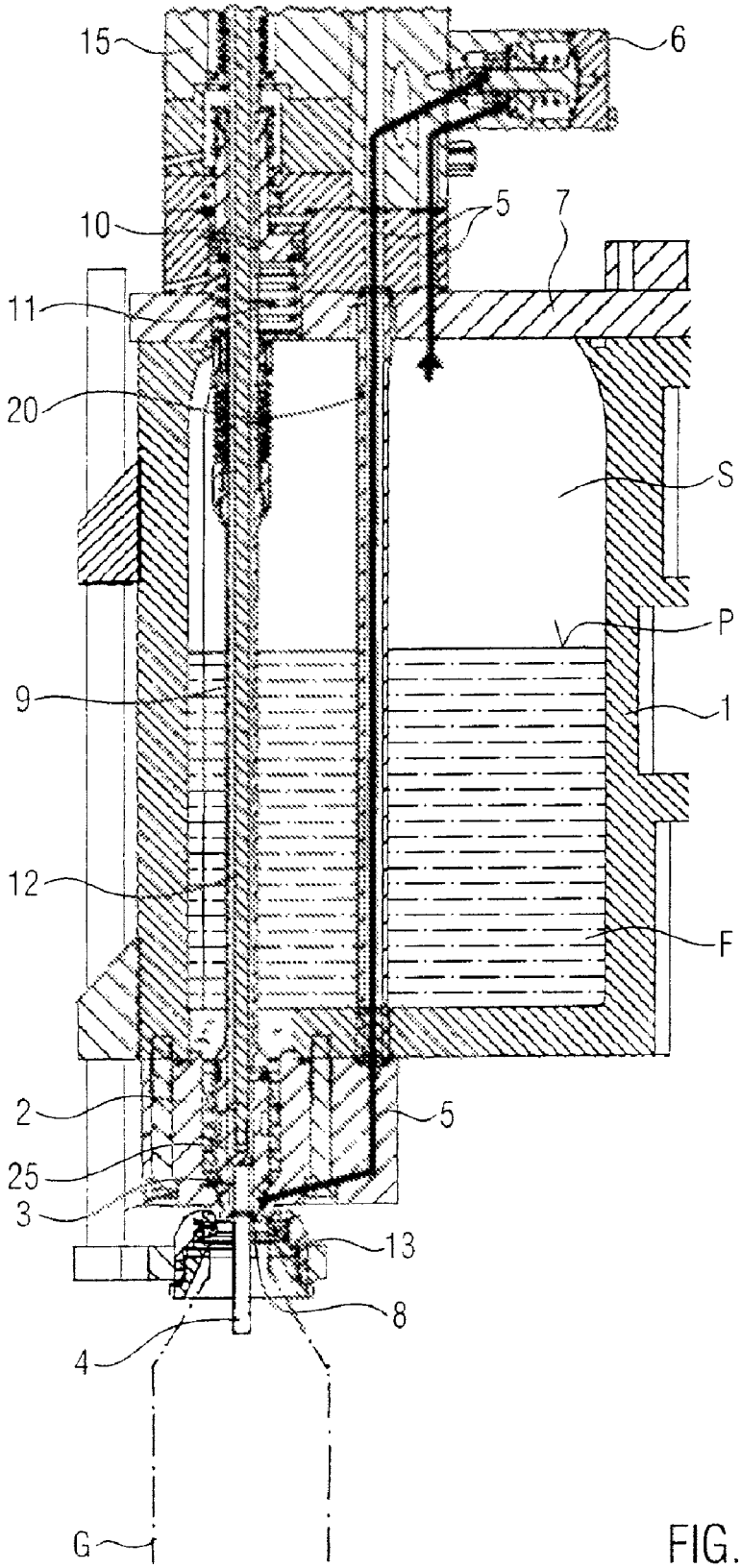
FIG. 1: A vertical section through the device for the filling of vessels, with the valve block partially omitted.
Figure 2:
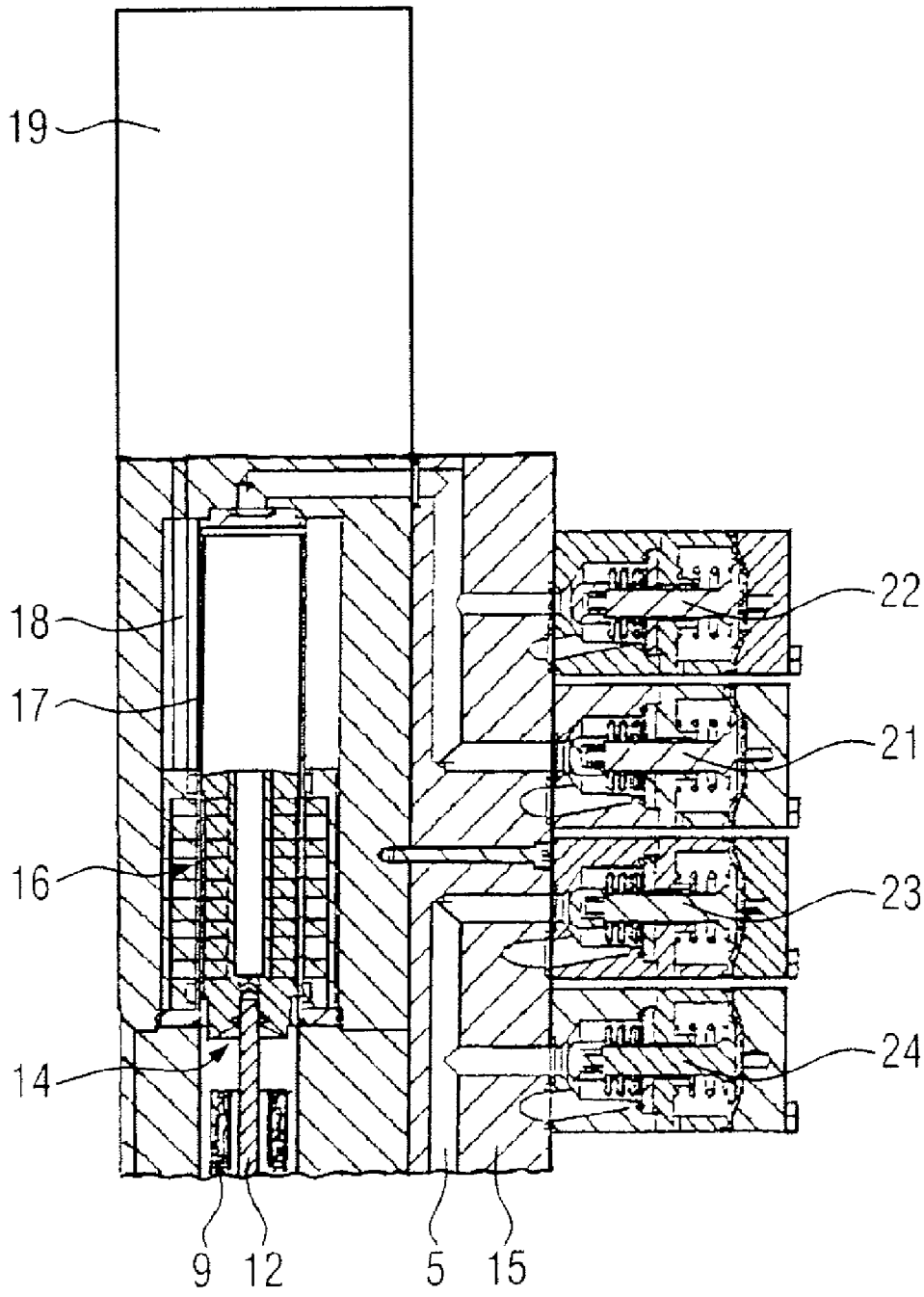
FIG. 2: A vertical section through the area of the valve block omitted in FIG. 1.

The device in accordance with FIGS. 1 and 2 is constructed for the decanting of a liquid F, such as wine or champagne, for example, into vessels G in the form of glass bottles. It has a circular container 1 that revolves around a vertical rotational axis, not depicted. The container is filled with the liquid F up to the level P and, above that, with a pressurized gas S under excess pressure, such as CO2, for example. The conveying of the liquid and the pressurized gas to the container 1 is carried out in the conventional manner by means of conduits, rotary distributors, etc., not depicted.

Several tube-like filling pipes 2 are positioned on the lower side of the container 1, distributed evenly over the circumference. A liquid valve 3 with a height-adjustable valve body 25, by means of which the actual liquid discharge unit 8 can be closed off, is provided in these. The valve body 25 is provided with a tube-like extension 9 which is, by means of a bellows, guided in a gas-tight manner through the cover 7 of the container up to a pneumatic cylinder 10, through which the valve body 25 is able to move downwardly against the valve seat against the force of a spring 11.

The lower section of a return gas pipe 4, the upper portion of which is formed by the tubular extension 9, is supported in the lower end area of the valve body 25 in a gas-tight and displaceable manner. The return gas pipe 4 defines a penetrating gas channel, the lower section of which discharges into the open or into a vessel G pressed against the filling pipe 2 in a gas-tight manner, as the case may be, with interposition of a centering bell 13, and the upper section of which discharges into a gas-filled space 14. This is positioned inside a valve block 15, which is attached to the cover 7 of the container 1.

The lower portion of the return gas pipe 4 is connected with a plunger 12 which, within the extension 9, is directed upwardly upon the formation of a circular space and projects slightly out of the extension 9. The protruding end of the plunger 12 is attached to the internal portion of a magnetic coupling 16 which can be moved within a cylindrical bushing 17 extending upwardly inside the gas-filled space 14. The outer part of the magnetic coupling 16 is supported displaceably on its outer side, which coupling is connected with a servomotor 19 by means of a rod 18. By this means, the lower section of the return gas pipe 4 can be adjusted in height.

A gas pipe 5, the lower area of which is formed by boreholes in the filling pipe 2, discharges laterally into the liquid discharge unit 8 below the liquid valve 3. The middle area of the gas pipe 5 is formed by a vertical tube part 20 which is inserted between the base and the cover 7 of the container 1. The upper area of the gas pipe 5 is formed by boreholes in the valve block 15 which, on the one hand, connect the tube part 20 with a pre-stressing valve 6 positioned on the valve block 15 and, on the other hand, connect the pre-stressing valve 6, along with a borehole in the cover 7, with the gas-filled space in the container 1. Through the opening of the pre-stressing valve 6, pressurized gas S can flow into a vessel G through the gas pipe 5 and the liquid discharge unit 8 until equal pressure prevails between the vessel and the container 1. The liquid valve 3 is thereupon opened automatically by the spring 11, and the liquid F flows out of the container 1, through the opened liquid valve 3 and the liquid discharge unit 8, into the vessel. The gas thereby forced out of the vessel G escapes through the return gas pipe 4 and into the gas-filled space 14.

The pre-stressing valve 6 is closed during this actual filling process, so that no liquid can move upwardly into the gas pipe 5. liquid or particles of foam possibly entering into the gas pipe 5 through the borehole in the cover 7 can, despite the large distance to the level P, immediately drop downwardly again. In this way, an absolutely dry pressurization is guaranteed.

During the filling process described above, the return gas escapes from the gas-filled space 14 by way of a return gas valve 21 connected with this through boreholes in the valve body 15 and back into the container 1, or into its own return gas channel. At the end of the filling process, a relief of the pressure in the vessel G is carried out, with closed liquid valve 3, closed return gas valve 21, and closed pre-stressing valve 6, through a relief valve 22 positioned on the valve block 15, which relief valve is connected with the gas-filled space 14 again through boreholes in the valve block 15.

In addition, one more correction valve 23 and one vacuum valve 24 are connected with the gas pipe 5 through boreholes in the valve body 15. CO2 gas can be brought through the correction valve 23 and into the vessel G at a pressure slightly higher than in the container 1, whereupon the liquid is forced precisely up to the lower section of the return gas pipe 4, out of the vessel G, through the return gas pipe 4, and into the interior of the container 1. Before the actual filling process, the vessel G can be connected with a vacuum pump by way of the vacuum valve 24, in order to suction most of the air out of the vessel G.

The invention claimed is:

1. A device for filling of vessels, comprising a container for liquid up to a level and a pressurized gas-filled space above the level, the container having a base at a lower side and a cover at an upper side, a filling pipe at the base of and connected to the container, the filling pipe containing a liquid valve and a return gas pipe extending upwardly from a liquid discharge unit located in the filling tube below the liquid valve through the filling valve, the container and the cover, a gas pipeline extending from the filling tube with a long lower section upwardly through the container and being connected by a short upper substantially vertical section with the pressurized gas-filled space of the container by a pre-stressing valve positioned on a valve block positioned on the upper side of the container for discharging pressurized gas into the filling tube when the pre-stressing valve is open and before the liquid valve is opened, wherein the long lower section of the gas pipeline is arranged outside of the return gas pipe, wherein the long lower section of the gas pipeline is connected from outside of the filling tube with the liquid discharge unit upwardly from the filling tube to the pre-stressing valve.

2. A device in accordance with claim 1 wherein the gas pipeline penetrates the container outside of the return gas tube essentially vertically.

3. The device in accordance with claim 1, wherein the long lower section of the gas pipeline is formed by bore holes in the filling pipe discharging laterally into the liquid discharge unit and by a vertical tube part inserted between the base and the cover of the container, and by bore holes in the valve block connecting the vertical tube part with the pre-stressing valve.

4. The device in accordance with claim 3, wherein the bore hole of the long lower section of the gas pipeline includes in the filling tube a vertical bore hole connected with the vertical tube part and a lateral downward inclined bore hole connecting the vertical bore hole and the liquid discharge unit.

* * * * *